US005699094A

United States Patent [19]

Burke et al.

[11] Patent Number: 5,699,094

[45] Date of Patent: Dec. 16, 1997

[54] INK JET PRINTING DEVICE

[75] Inventors: Cathie J. Burke; Almon P. Fisher, both of Rochester; Diane Atkinson, Webster; Mildred Calistri-Yeh, Geneva, all of N.Y.

[73] Assignee: Xerox Corporation, Stamford, Conn.

[21] Appl. No.: 515,180

[22] Filed: Aug. 11, 1995

[51] Int. Cl.[6] ..... B41J 2/178

[52] U.S. Cl. ..... 347/63

[58] Field of Search ..... 347/63, 64, 65

[56] References Cited

U.S. PATENT DOCUMENTS

| | | | |
|---|---|---|---|
| 4,638,337 | 1/1987 | Torpey et al. | 346/140 R |
| 4,774,530 | 9/1988 | Hawkins | 346/140 R |
| 4,829,324 | 5/1989 | Drake et al. | 346/140 R |
| 4,890,126 | 12/1989 | Hotomi | 347/47 |
| 5,008,689 | 4/1991 | Pan et al. | 346/140 R |
| 5,539,175 | 7/1996 | Smith et al. | 347/47 |

*Primary Examiner*—Valerie Lund

[57] ABSTRACT

An ink jet printhead has improved resistance to the corrosive effects of ink by coating ink sensitive areas with a photo-imageable benzocyclobutene (BCB) polymer. The BCB can be patterned so as to provide a protective coating over selected areas while leaving other areas uncoated. In one described embodiment, a thermal ink jet printer is formed by bonding together a channel plate and a heater plate. Resistors and electrical connections are formed in the surface of the heater plate. A BCB layer is formed so as to overlie the heater plate to protect the electrical elements while providing pit structure for the heater and for ink flow bypass.

14 Claims, 1 Drawing Sheet

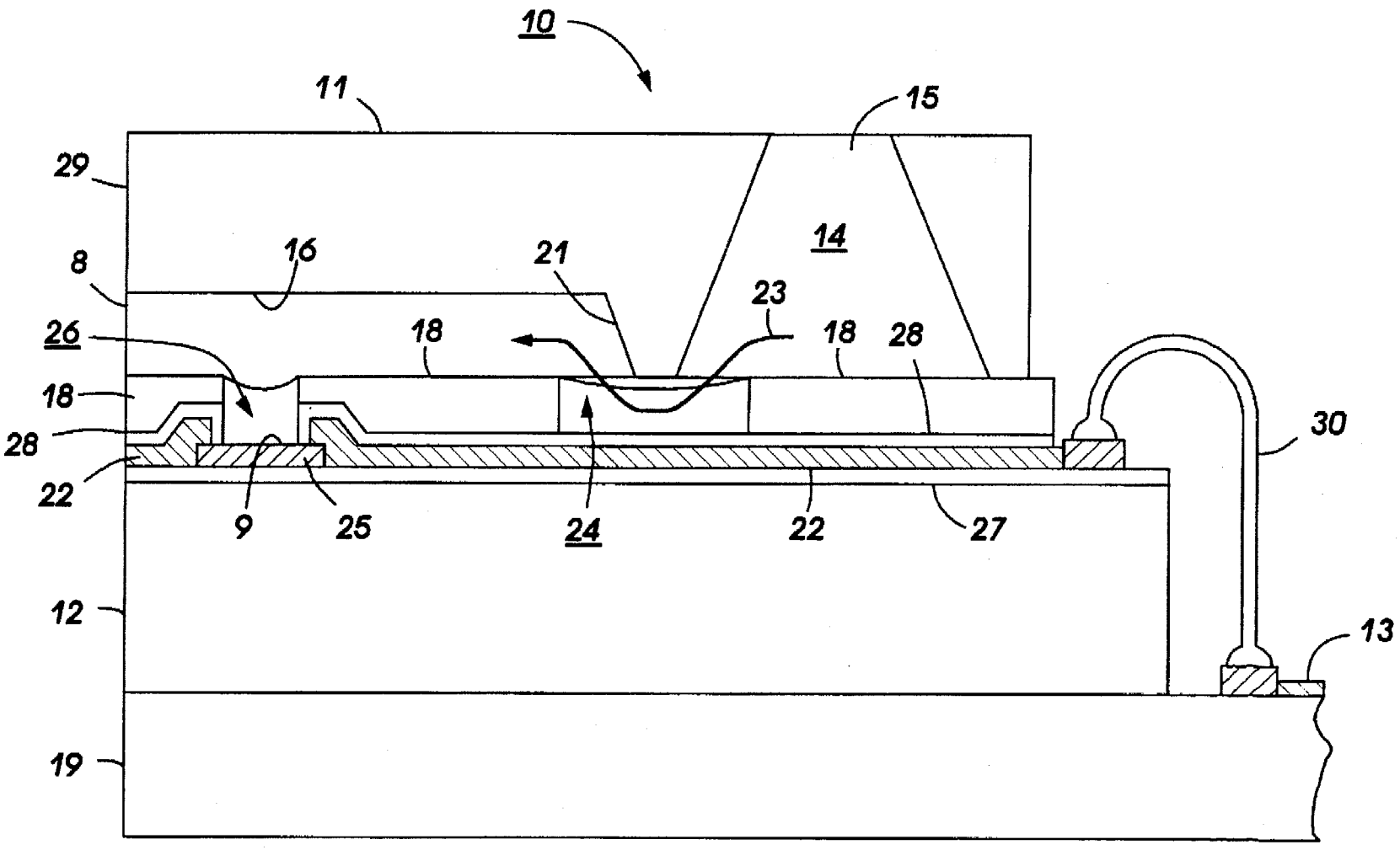
10
11
13
14
15
16
18
19
21
22
23
24
25
26
27
28
29
30
8
9
12

INK JET PRINTING DEVICE

BACKGROUND AND MATERIAL DISCLOSURE STATEMENT

This invention relates to an ink jet printing device which uses energy to cause ink droplets contained within channels formed internally to the printhead to be expelled from an orifice onto a recording material. More particularly, the invention relates to an ink jet printhead having improved protection from the corrosive effects of ink on ink sensitive areas of the printhead.

In the ink jet printing art, a printhead is provided having one or more ink filled channels communicating with an ink supply chamber, the channels having one end formed as a nozzle orifice. The ink forms a meniscus at the nozzle prior to being expelled. Energy is applied to the ink channels in the form of heat created by pulsing heating resistors or by a piezoelectrically applied force to the channel walls to cause an ink droplet to be expelled from the nozzle onto the recording material. After a droplet is expelled, additional ink replenishes the channel and reforms the meniscus.

The ink must flow in such a manner that the energy generator, either the resistor heater element in a thermal ink jet printer or piezoelectric plates in the piezo printer are in sufficient contact to transfer energy to the ink. Because of the corrosive nature of the ink used, the electronic circuitry associated with the energy generators must be protected by a protective coating which must also be photo-imageable to pattern and expose the energy generating elements during the fabrication process. Preferred photo-imageable materials used extensively in the prior art for passivation and other purposes are polyimide and dry film solder mask polymers (PMMA). For example, as disclosed in U.S. Pat. Nos. 4,774,530 and 4,829,324, the top surface of a heater wafer is patterned with a relatively thick pattern layer of polyimide which is applied in a curing process and passivates the underlying electronic circuitry while also placing the heater surface at the bottom of a pit structure to improve ink ejection characteristics. U.S. Pat. No. 5,113,203 discloses a printhead in FIG. 1 where electrodes 209, 210 are protected by a spin coated photosensitive polyimide layer 213, 214. Polymers have also been used to form a nozzle plate for a printhead as disclosed in U.S. Pat. No. 5,291,226.

The use of polyimides and PMMA's in ink jet printheads has certain disadvantages. One is the poor resistance to inks having strong bases and polar solvents, resulting in corrosion of the polyimide coating. Another disadvantage is sensitivity to high temperatures. Another disadvantage of the PMMA composition is sensitivity to high temperatures. A still further disadvantage is shrinkage during the curing process lessening control over the planarity of the polyimide layer.

SUMMARY OF THE INVENTION

It is an object of the present invention to provide an ink jet printing device wherein an improved photo-imageable formulation is used to provide passivation and protective coatings to internal components of the printhead which are susceptible to the corrosive effects of the ink.

The improved photo-imageable material is provided by forming the coating as a layer of a cured photo-imageable benzocyclobutene (BCB) polymer.

More particularly, the present invention relates to a printhead for ejecting a recording liquid onto a recording medium, the printhead having an internal structure which includes at least a channel for holding said recording liquid, at least one nozzle for ejecting liquid onto the recording medium, channel means providing a liquid flow path between said chamber and said nozzle, an energy generator for introducing energy into the liquid contained in said channel, means for selectively energizing said energy generating means so as to cause periodic ejections of said liquid through said nozzle onto said recording medium and a cured photo-imageable benzocyclobutene (BCB) polymer formed in at least a portion of said internal structure.

BRIEF DESCRIPTION OF THE DRAWING

FIG. 1 is an enlarged cross-sectional view of a thermal ink jet printer showing a heater plate having a patterned benzocyclobutene polymer layer passivating electronic control elements, the layer further forming pits around the heater elements.

DESCRIPTION OF THE INVENTION

The invention will be described in conjunction with a thermal ink jet printer of the type disclosed in U.S. Re. 32,572 to Hawkins et al., U.S. Pat. No. 5,010,355 to Hawkins et al. and U.S. Pat. No. 4,851,371 to Fisher et al, the disclosures of all of which are hereby incorporated by reference. It is understood that the invention has utility and other types of printhead structures as will be seen. As disclosed in these patents, thermal ink jet printheads are generated in batches by aligning and adhesively bonding an anisotropically etched channel wafer to a heater wafer followed by a dicing step to separate the bonded wafer into individual printheads. The prior art interposed a patterned thick film insulative layer between the channel wafer and the heater wafer. A preferred insulation material has been polyimide. According to the invention, and as shown in FIG. 1, the polyimide layer has been replaced by a layer 18 of a photo-imageable benzocyclobutene resin. FIG. 1 shows a cross-sectional view of a printhead. Printhead 10 comprises an anisotropically etched channel plate 11 aligned and bonded to heater plate 12. The printhead is fixedly attached to a daughter board 19 having electrodes 13 thereon which connect to a drive circuit and power supply (not shown). The channel plate 11 has a through etched reservoir 14 with its open bend serving as inlet 15 and a plurality of channels 16 anisotropically etched therein. Ends of the channels 16 open through nozzle face 29 and terminate at slanted ends 21. The open ends of the channels serve as nozzles 8. The heater plate has an array of heating elements 25 and addressing electrodes 22 formed on the surface of the heater plate 12 which confront the channel plate. The heating elements and electrodes are formed on an insulative layer 27 and are passivated by an insulative layer 28. A protective layer 9, such as tantalum, is deposited over the heating elements. Thick film insulative layer 18, in a preferred embodiment, is a 10 micron thick photosensitive BCB interposed between the heater plate and the channel plate. Layer 18 is patterned to expose the heating elements, thereby placing them in separate pits 26 and to form ink flow bypass pits 24 between the reservoir 14 and the ink channel 16. Ink thus flows from reservoir 14 to channels 16 around the closed end of the channels 21 as shown by arrow 23. The addressing electrodes of the printhead is connected to the daughter board electrodes 13 by wire bonds 30 which are subsequently passivated (not shown). The anisotropically etched channels 16 have a triangular cross-sectional area and the materials surrounding the nozzle at the nozzle face 29 is silicon on two sides of the triangular shaped nozzle and thick film layer material layer on the third side.

In a preferred embodiment, layer 18 comprises a photoimageable Benzocyclobutene (BCB) formulated to be photosensitive to ultraviolet light and curable in a single step. In a general formulation:

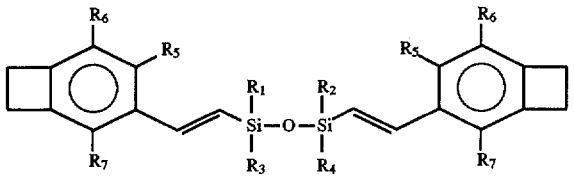

wherein each R is independently: hydrogen, aliphatic including alkyls, halogens, such as Cl, Br, and the like, and $SiH_3$, $Si(OH)_3$, and COOH. In a specific embodiment, the BCB contains by weight 35–63% divinylsiloxane-bis benzocyclobutene isomers, and an aromatic solvent such as mesitylene, the formulation being:

Modified BCB

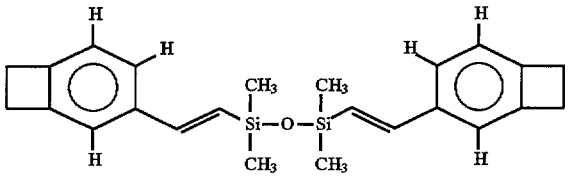

Mesitylene

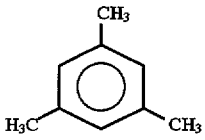

The BCB formulation further comprises photocrosslinkers m-azidophenyl sulfone, (0.2–3.0%) and 2,6-bis (4-azidobenzylidene)-4-methylcyclo-hexanone (0.25–3.0%) and an antioxidant polymerized 1,2-dihydro-2,2,4-trimethylquinoline (0.2–3.0%). The orientation of the polymer is a three-dimensional chain expressed by the following chemical reaction, which may be continued indefinitely:

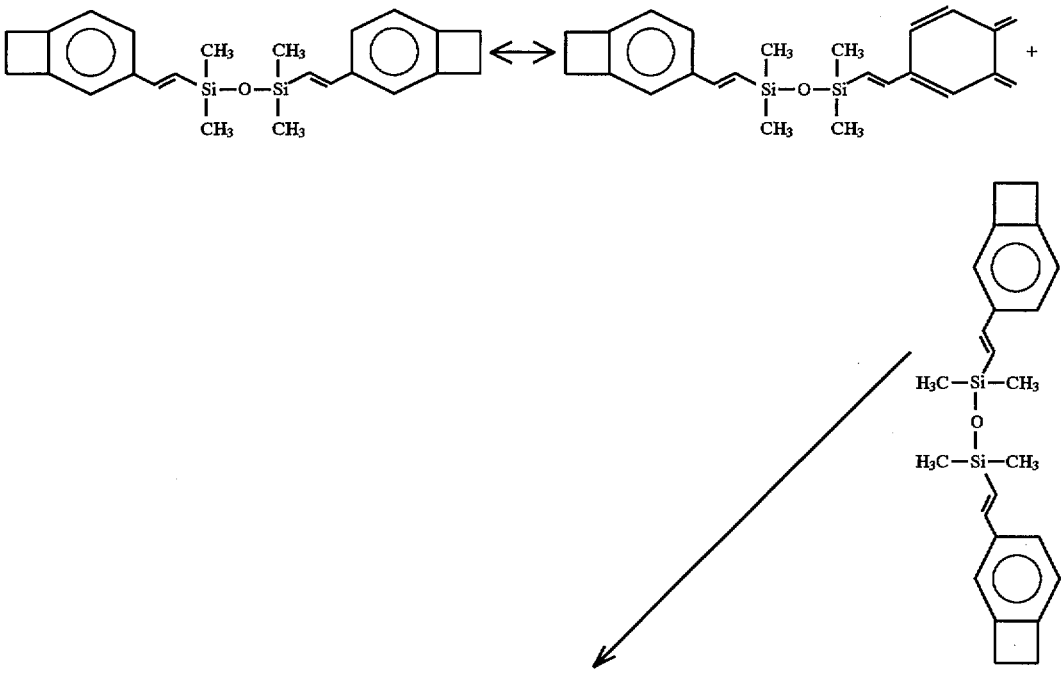

-continued

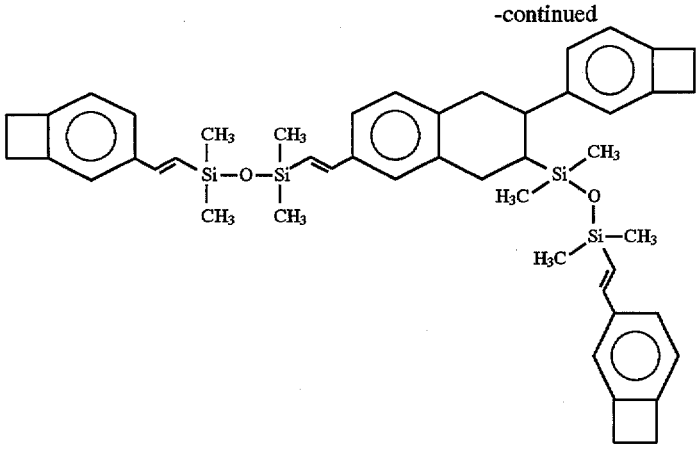

The BCB layer is cured in one embodiment by the following process. The cure takes place in an oxygen-free environment and can be by oven, hot plate, RTC, e-beam. For an oven curing, the cure cycles were as follows:

soft cure: 5 min. ramp to 50° C., 5 min. soak; 15 min. ramp to 100° C., 15 min. soak; 15 min. ramp to 150° C., 15 min soak; 30 min. ramp to 210° C., 30 min. soak followed by natural cool down;

hard cure: 5 min. ramp to 50° C., 5 min. soak; 15 min. ramp to 100° C., 15 min. soak; 15 min. ramp to 150° C., 15 min soak; 60 min. ramp to 250° C., 60 min. soak followed by natural cool down.

The following are two sample patterning processes for the different thicknesses of material:

SAMPLE 1

1. Deposit 2–3 gm Dow BCB type #93006-28;
2. Spin at 500 RPM for 20 sec., 2500 for 30 sec.;
3. Bake for 20 min. at 75°;
4. Expose in contact with 250 mJoules;
5. Puddle develop for 50 sec. with Stoddard solvent;
6. Rinse for 20 sec. in proponal;
7. Cure (final thickness 5.3 microns).

SAMPLE 2

1. Deposit 2–3 gm Dow BCB type #93005-83;
2. Spin at 500 RPM for 20 sec., 2700 for 30 sec.;
3. Bake for 40 min. at 75°;
4. Expose in contact with 360 mJoules;
5. Puddle develop for 120 sec. with Stoddard solvent;
6. Rinse for 20 sec. in proponal;
7. Cure (final thickness 8.6 microns).

The BCB layer is a polymer structure with a three-dimensional chain making it extremely chemically resistant. Further, because the polymerization reaction is just a re-orientation of the monomers, there is no shrinkage during curing, and the coating has good planerization properties. This characteristic is unlike the polyimide of the prior art where hydrolysis must take place resulting in significant shrinking during cure and a result in lack of planerity.

The above description provides an example of using a photo-imageable BCB coating to form a pit layer in a specific thermal ink jet printhead fabrication. In the same printhead, another use of the BCB coating would be to create the adhesive bond between the channel plate 11 and the heater 12. As disclosed in U.S. Pat. No. 4,678,529, hereby incorporated by reference, a printhead is disclosed wherein the channel plate is bonded to the heater plate by applying a diluted EPON® thermoplastic adhesive to the channel plate by a spin coating process. The photo-imageable BCB formulation of the present invention can be used instead of the EPON® formulation.

The efficacy of the BCB formulation is not limited only to the structure disclosed above but is equally useful in any of the printheads discussed supra. For example, the nozzle member disclosed in U.S. Pat. No. 5,291,226 is described as formed of a polymer material section. The BCB coating can be used to provide a section through which the nozzles can be formed, the section providing enhanced protection from the effects of ink on both sides of the nozzle plate. As another example, and as disclosed in U.S. Pat. No. 5,008,689, a printhead includes an orifice plate and an ink channel, the ink in the channel heated by a resistor. The resistor is formed on a plastic layer. The present BCB polymer formulation can be used to form the plastic layer. The contents of this patent are hereby incorporated by reference.

In sum, the cured photo-imageable BCB polymer of the present invention can be used as a protective layer, or as a base layer to provide a structure such as a pit layer for any regions of an ink jet printhead which would be effected by the corrosiveness of the particular ink being used.

While the embodiment disclosed herein is preferred it will be appreciated from this teaching that various alternative modifications, variations or improvements therein may be made by those skilled in the art which are intended to be encompassed by the following claims:

We claim:

1. A printhead for ejecting a recording liquid onto a recording medium, the printhead having an internal structure which includes at least a channel for holding said recording liquid, at least one nozzle for ejecting liquid onto the recording medium, channel means providing a liquid flow path between said chamber and said nozzle, an energy generator for introducing energy into the liquid contained in said channel, means for selectively energizing said energy generating means so as to cause periodic ejections of said liquid through said nozzle onto said recording medium and a cured photo-imageable benzocyclobutene (BCB) polymer formed in at least a portion of said internal structure.

2. The printhead of claim 1, wherein the printhead internal structure includes an upper substrate comprising a channel plate and a lower substrate comprising a heater plate, the two plates bonded together to form channels therebetween, said BCB polymer forming an adhesive layer between said channel and heater plate.

3. The printhead of claim 1, wherein the printhead includes an upper substrate comprising a channel plate etched to form a set of parallel groves, the grooves serving as said channel means and a lower substrate, said energy generating means comprising an array of heater elements formed on said lower substrate surface, said means for selectively energizing said energy generating means including addressing elements formed on said lower substrate surface, the upper and lower substrates, when aligned and bonded together forming said printhead and wherein said BCB polymer is deposited on the lower substrate over the heating and addressing elements and patterned to define therein heater and recess pits.

4. The printhead of claim 1, wherein a plurality of nozzles are used to selectively eject the recording liquid and, said nozzles being formed in a plate comprising said photo-imageable BCB formulation.

5. The printhead of claim 1, wherein said energy generator is a piezoelectric transducer which, when energized, constricts said channel means to cause said droplets to be expelled.

6. The printhead of claim 1, wherein the BCB is of the formula:

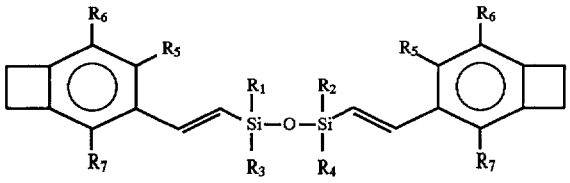

wherein each R is independently: hydrogen, aliphatic including alkyls, halogens, and $SiH_3$, $Si(OH)_3$, and COOH and its cross-linked product.

7. The printhead of claim 1, wherein the BCB contains by weight 35–63% divinylsiloxane-bis benzocyclobutene isomers, and an aromatic solvent such as mesitylene, the formulation being:

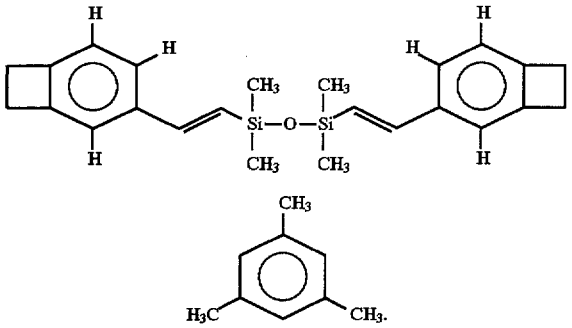

8. In a process for preparing a printhead suitable for ink jet printing the steps of:

dissolving a photo-imageable benzocyclobutene in a solvent, applying the solution thus formed to at least a portion an internal structure of said printhead susceptible to ink corrosion, the solvent evaporating to leave a film and curing the film.

9. The process according to claim 8, wherein the benzocyclobutene is of the formula:

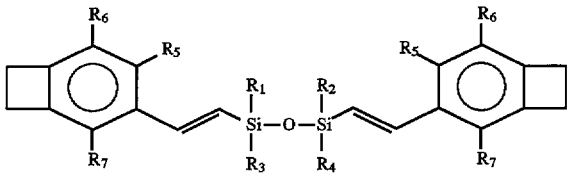

wherein each R is independently: hydrogen, aliphatic including alkyls such as $C.H_3$, $CH_2CH_3$, halogens, such as Cl, Br, and $SiH_3$, $Si(OH)_3$, and COOH.

10. The process according to claim 8, wherein the benzocyclobutene is of the formula:

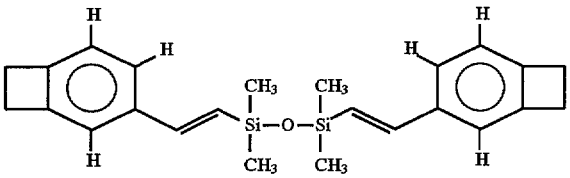

11. An ink jet printhead comprising a plurality of channels, wherein the channels are capable of being filled with ink from an ink supply and wherein the channels terminate in nozzles on one surface of the printhead, the nozzles being formed in a layer comprising a photo-imageable benzocyclobutene polymer.

12. An ink jet printhead comprising a plurality of channels, wherein the channels are capable of being filled with ink from an ink supply, the ink in the channels being heated by a resistor formed on a plastic layer, and wherein the channels terminate in nozzles on one surface of the printhead, the plastic layer comprising a photo-imageable benzocyclobutene polymer.

13. A thermal ink jet printhead which includes an orifice plate having an ink channel therein and an ink reservoir for supplying ink to said orifice, the said channel, a heater for heating the ink in said channel upon application of a current therethrough and a substrate for supporting said heater, the substrate comprising a cured photo-imageable benzocyclobutene (BCB) polymer.

14. An improved ink jet printhead of the type having a silicon upper substrate in which one surface thereof is anisotropically etched to form both a set of parallel grooves for subsequent use as ink channels and an anisotropically etched recess for subsequent use as a manifold, and further having a lower substrate in which one surface thereof has an array of heating elements and addressing electrodes formed thereon, the upper and lower substrates being aligned, mated, and bonded together to form the printhead with a thick film insulative layer sandwiched therebetween, the thick film insulative layer having been deposited on the surface of the lower substrate and over the heating elements and addressing electrodes and patterned to form recesses therethrough to expose the heating elements and terminal ends of the addressing electrodes prior to said mating and bonding of the substrates, wherein the improvement comprises:

forming the thick film insulative layer from a photo-imageable BCB polymer resin.

* * * * *